United States Patent [19]

Farberov

[11] 4,442,614

[45] Apr. 17, 1984

[54] ARTICLE OF FOOTWEAR

[76] Inventor: Iosef Farberov, 868 E. 7th St., Brooklyn, N.Y. 11230

[21] Appl. No.: 334,884

[22] Filed: Dec. 28, 1981

[51] Int. Cl.[3] ..... A43B 13/00; A43B 3/28

[52] U.S. Cl. ..... 36/103; 36/112

[58] Field of Search ..... 36/112, 115, 32 R, 25 R, 36/83, 84, 87, 103, 134

[56] References Cited

U.S. PATENT DOCUMENTS 4,041,619 8/1977 Sapper ..... 36/103

4,050,168 9/1977 Pace ..... 36/112

4,333,249 6/1982 Schaefer ..... 36/134

4,348,821 9/1982 Daswick ..... 36/103

*Primary Examiner*—Patrick D. Lawson

*Attorney, Agent, or Firm*—Ilya Zborovsky

[57] ABSTRACT

An article of footwear has upper and lower parts, wherein the lower part or sole has a plurality of roller-shaped portions separated from a remaining portion by depression. Four roller-shaped portions may be provided in four corners of the article. Two roller-shaped portions may be provided in each corner.

8 Claims, 3 Drawing Figures

ARTICLE OF FOOTWEAR

BACKGROUND OF THE INVENTION

The present invention relates to an article of footwear, such as shoes, boots, keds etc.

Known articles of footwear have a lower part or sole which does not have special roller-shaped formations and depressions surrounding the same. Thus, the material consumption of the known articles of footwear is considerably high and the appearance of the same is not sufficiently attractive.

SUMMARY OF THE INVENTION

Accordingly, it is an object of the present invention to provide an article of footwear which is advantageous as compared with the known articles.

In keeping with these objects and with others which will become apparent hereinafter, one feature of the present invention resides, briefly stated, in an article of footwear which has lower and upper parts, and in which the lower part is provided with at least one roller-shaped portion surrounded by a deoression, It is advantageous when four corner regions of the lower part are provided with at least one roller-shaped portion. The thus designed article of foorwear economizes the material and also provides for an attractive appearance resembling roller-skates.

The novel features of the present invention are set forth in particular in the appended claims. The invention itself, however, will be best understood from the following description of preferred embodiments, which is accompanied by the following drawings.

DESCRIPTION OF PREFERRED EMBODIMENTS

An article of footwear in accordance with the present invention has an upper part 1 and a lower part or sole 2.

Figure 1:
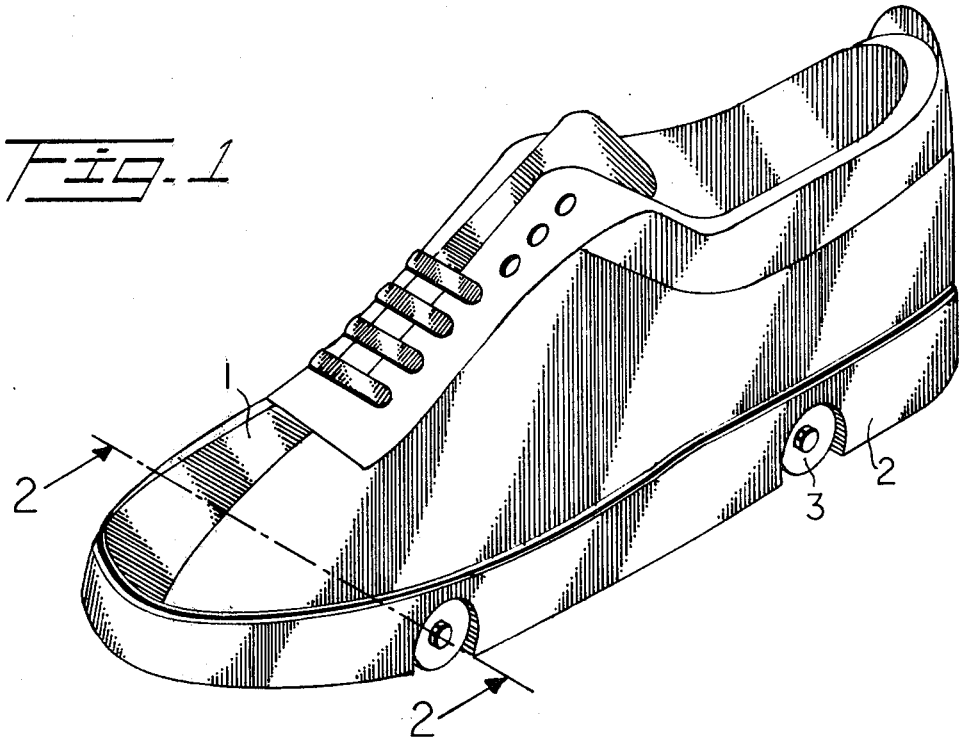
FIG. 1 is a lateral view of an article of a footwear in accordance with one embodiment of the invention.

As can be seen from FIG. 1, the sole 2 of the inventive article of footwear has roller-shaped portions 3 which are separated from a remaining portion 4 of the sole 2 by groove-like depressions 5. It is advisable to provide the roller-shaped portions 3 at the front and rear ends and at both lateral sides of the sole 2, or in other words in four corner regions of the latter. In this case, the sole 2 resembles the base of roller-skates. However, smaller or greater numbers of the roller-shaped portions 3 are also possible.

Figure 2:
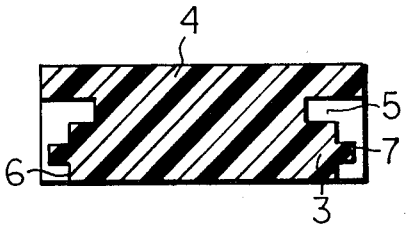
FIG. 2 is a rear view of the article of footwear of FIG. 1 partially sectioned.

As can be seen from FIG. 2, end faces 6 of the roller-shaped portion 3 are inwardly offset from lateral surfaces 5 of the article or a remaining portion of the sole 2. The depressions 5 themselves provide for material economy of the sole. When the faces 6 are also offset as described, and additional material economy is obtained. The roller-shaped portions 3 may also have axle-like projections 7. As can be seen from FIG. 2, the faces 6 of the roller-shaped portions 3 are symmetrical relative to the central longitudinal plane of the article of footwear or the sole 2.

Figure 3:
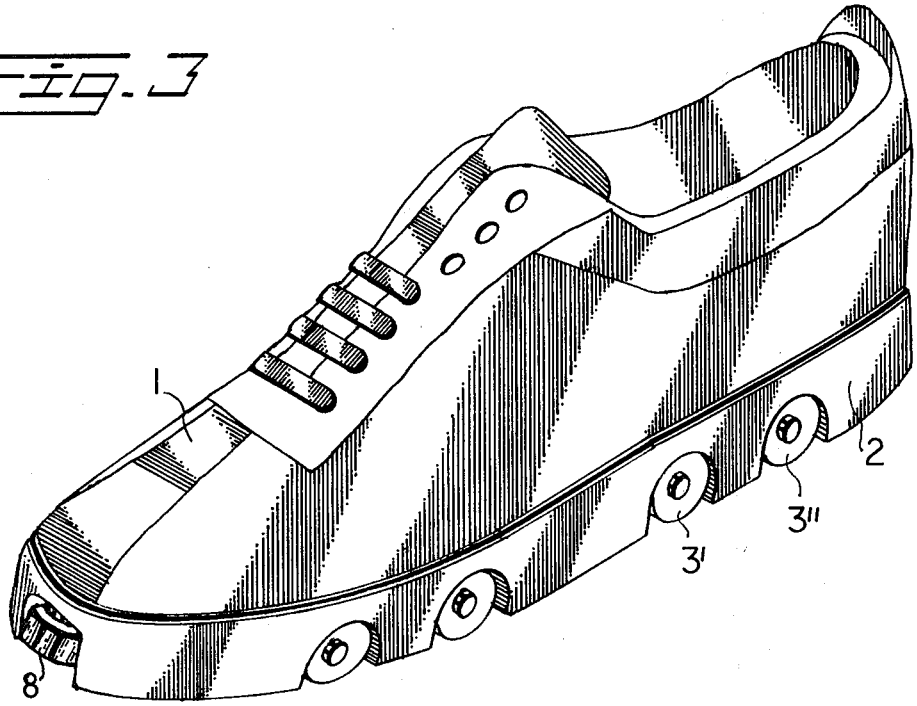
FIG. 3 is a lateral view of a fragment of the article of footwear in accordance with another embodiment of the invention.

FIG. 3 shows that two roller-shaped portions 3' and 3" may be arranged in each corner region of the article of footwear. This construction imitates roller-skates with double rollers. In addition, a front roller shaped portion 8 is provided on the tip of the article. The roller-shaped portion 8 has a substantially vertical axis, whereas the rollers 3,3' and 3" have substantially horizontal axes. The roller 8 may also be provided in the article of footwear shown in FIG. 1.

The roller-shaped portions 3 are advantageously of one piece with the remaining portion of the lower part or sole 2. However, they also may be formed as separate members and subsequently attached to the sole.

The invention is not limited by the details shown since various modifications and structural changes are possible without departing in any way from the spirit of the present invention.

What is claimed and desired to be protected by Letters Patent is set forth in the appended claims:

1. An article of footwear, comprising an upper part; and a lower part formed as an integral member and connected with said upper part, said lower part having at least one roller-shaped portion extending above the lower surface of said lower part and a groove which partially circumferentially surrounds said roller-shaped portion and separates said roller-shaped portion from a remaining portion of said lower part, wherein said roller-shaped portion and said remaining portion of said lower part are of one piece with one another.

2. An article of foorwear as defined in claim 1, wherein said lower part is formed as a sole, said sole being provided with said roller-shaped portion and said groove.

3. An article of footwear as defined in claim 1, wherein said roller-shaped portion has a substantially horizontal axis, and groove being substantially coaxial with said roller-shaped portion.

4. An article of footwear as defined in claim 1, wherein said lower part has four corner regions as considered in a plan view, each of said four corner regions being provided with at least one such roller-shaped portion and at least one such groove.

5. An article of footwear as defined in claim 4, wherein each of said corner regions of said lower part is provided with two such roller-shaoed portions.

6. An article of footwear as defined in claim 1, wherein said lower part has two lateral surfaces, said roller-shaped portion having two end faces at least one of which is offset inwardly of a respective one of said lateral surfaces.

7. An article of footwear as defined in claim 1, wherein both said end faces of said roller-shaped portion are inwardly offset from said lateral surfaces of said lower part so that said roller-shaped portion is symmetrical relative to a central longitudinal axis of said lower part.

8. An article of footwear as defined in claim 1, wherein said roller-shaped portion has a projection which is axle-shaped and extends laterally outwardly therefrom.

* * * * *